US006012972A

United States Patent [19]

Jankowski

[11] Patent Number: 6,012,972

[45] Date of Patent: Jan. 11, 2000

[54] METHOD FOR FLEXIBLE PROFILING OF GRINDING WORMS

[75] Inventor: Ralf Jankowski, Bad Sackingen, Germany

[73] Assignee: Reishauer AG, Wallisellen, Switzerland

[21] Appl. No.: 08/870,739

[22] Filed: Jun. 6, 1997

[30] Foreign Application Priority Data

Jun. 21, 1996 [DE] Germany ..... 196 24 842

[51] Int. Cl.[7] ..... B23F 13/04; B24B 1/00

[52] U.S. Cl. ..... 451/48; 451/47

[58] Field of Search ..... 451/47, 48, 56, 451/547, 541, 544; 125/11.03, 11.04, 11.13, 11.01, 11.11, 15

[56] References Cited

U.S. PATENT DOCUMENTS

| | | | |
|---|---|---|---|
| 1,778,541 | 10/1930 | Wildhaber | 451/48 |
| 4,475,319 | 10/1984 | Wirz | 451/47 |
| 5,339,794 | 8/1994 | Thyssen | 451/47 |
| 5,573,449 | 11/1996 | Mackowsky | 451/47 |

FOREIGN PATENT DOCUMENTS

| | | | |
|---|---|---|---|
| 186939 | 9/1956 | Germany | 451/48 |
| 32 35 790 A1 | 4/1983 | Germany . | |
| 44 36 741 A1 | 4/1996 | Germany . | |

*Primary Examiner*—Robert A. Rose
*Attorney, Agent, or Firm*—Sughrue, Mion, Zinn, Macpeak & Seas, PLLC

[57] ABSTRACT

The invention relates to a method for the profiling of single-start or multistart grinding worms for profile grinding of gear-teeth according to the principle of continuous generating grinding. The goal of the proposed profiling principle is to position the profiling tool and/or the grinding worm in relation to each other in such a way that different areas of an axial section of the grinding worm thread (referred to as shape elements) can be profiled with different geometric elements of the active area of a profiling tool (referred to as tool elements). According to the invention, for this purpose, with the aid of a coordination matrix a tool element is coordinated with each shape element of an axial section of the grinding worm thread. The coordination criteria applied in this regard are, in particular, short profiling time and flexible changing of the shape elements. Tool elements that lead to a punctiform contact between the worm thread and the profiling tool are coordinated with shape elements of the worm thread axial section that must be flexibly changeable. On the other hand, longer shape elements are profiled by means of the more productive line contact. For the positioning of the grinding worm and the profiling tool in relation to each other, besides the linear axes known with respect to the profiling of grinding worms, for achieving the shifting and feeding movement, swivelling axes are also used for swivelling the profiling tool and/or the grinding worm.

5 Claims, 5 Drawing Sheets

Figure 1B:
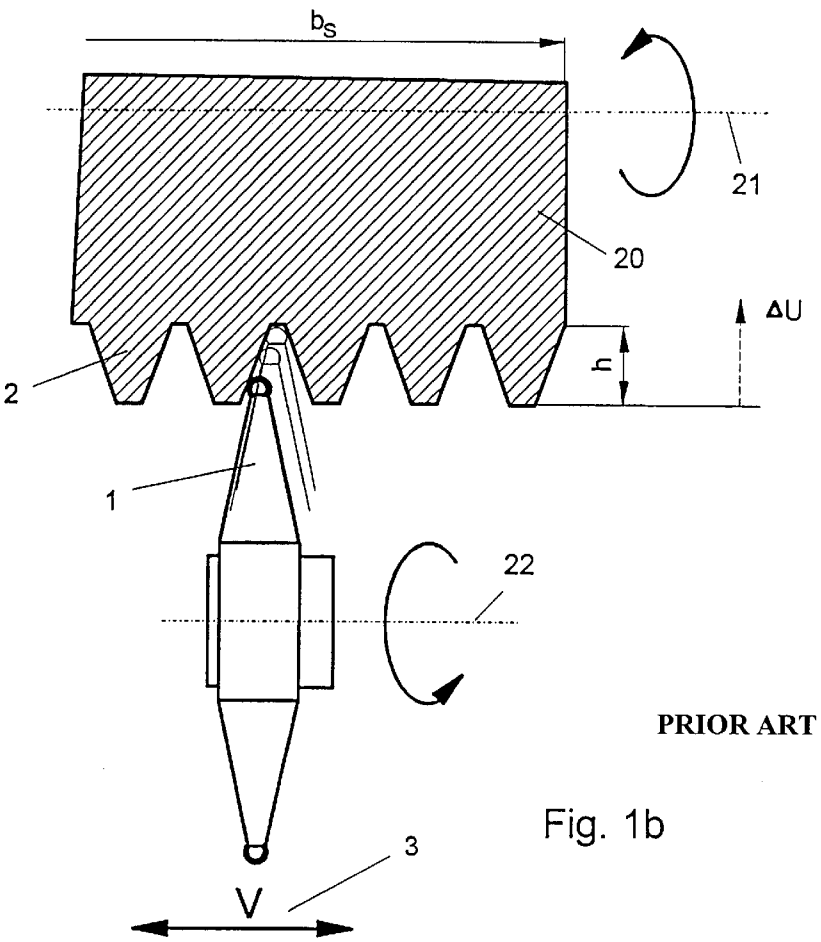
PRIOR ART Fig. 1b

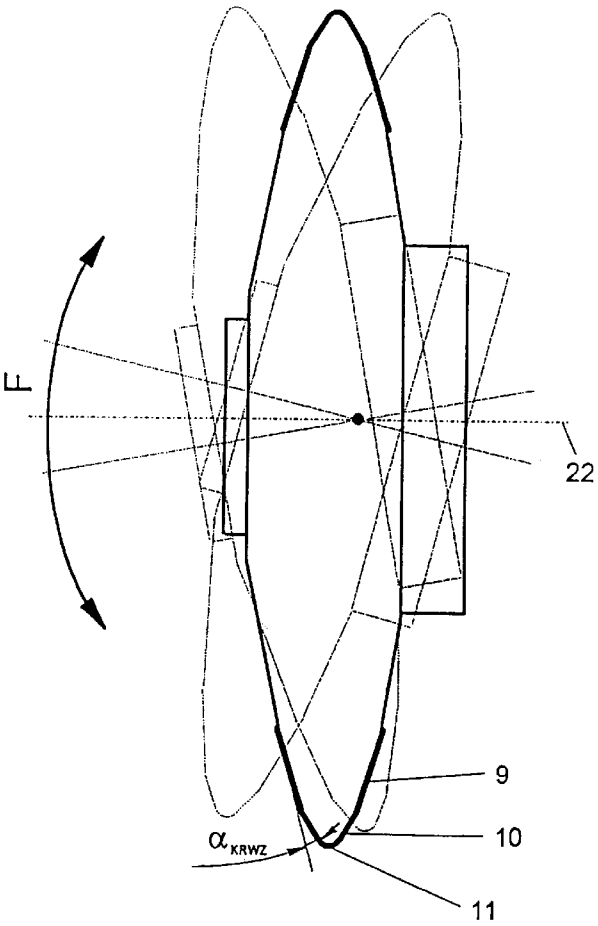
Fig. 2b
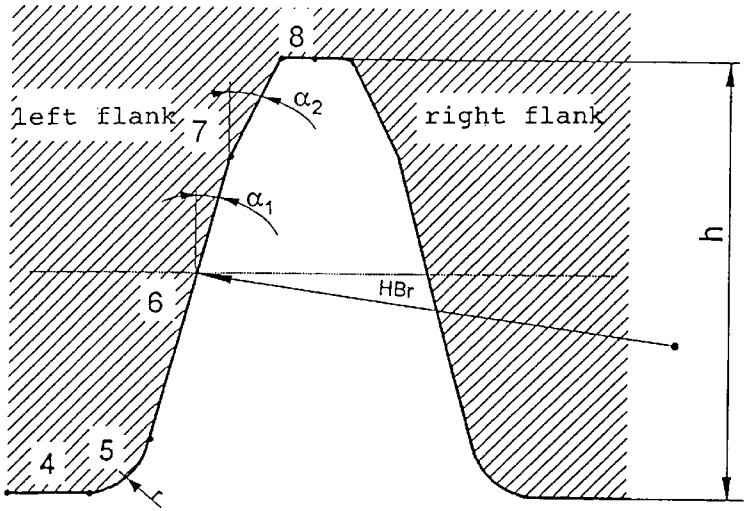
Fig. 2a
| tool element \ form element worm thread | form element4 (crown) | form ele-ment 5 (crown radius) | form element6 (flank1) | form ele-ment 7 (flank2) | ... |
|---|---|---|---|---|---|
| tool element 9 (line 1) | | | X | | |
| tool element10 (line 2) | | | | X | |
| tool element11 (radius) | X | X | | | |
| ... | | | | | |
Fig. 2c

METHOD FOR FLEXIBLE PROFILING OF GRINDING WORMS

The invention relates to a method for the profiling of single-start or multistart grinding worms for profile grinding of gear-teeth according to the principle of continuous generating grinding.

STATE OF THE ART

With the known methods for the profiling of grinding worms, a disk-shaped profiling tool is used in many cases. This profiling tool is moved by a shifting movement parallel to the axis 21 of a grinding spindle with a mounted, rotating grinding worm 20, whereby the profiling tool 1 mounted on a profiling spindle with, the axis 22 touches the tip, the face and/or the root of one or both flanks of the grinding worm thread. In this connection, the shifting movement of the profiling tool 1 and the rotational movement of the grinding worm 20 are coordinated precisely in such a way that after a worm rotation the profiling tool has travelled the distance Pi x modulus x number of threads. From the numerous related known method specifications, two general principles are known. In principle 1, the active area of the disk-shaped profiling tool has a single- or double-conical profile (FIG. 1*a*). During the profiling procedure, this profile shape leads to a line contact between the profiling tool 1 and an axial section of the grinding worm thread 2. These contact relationships have the advantage that with a shifting movement 3 over the width of the grinding worm $b_s$, the entire height of the worm thread h including the root and tip areas can be profiled. The result is very short profiling times. This method is disadvantageous, however, with regard to creating modifications in the direction of the worm thread height h. These can only be introduced once into the single- or double-conical profile of the profiling tool. Subsequent changes to these modifications are quite time-consuming and costly. Since with this method principle, entire areas of a worm thread axial section are always in contact, it is hereinafter referred to as profile dressing.

Figure 1A:
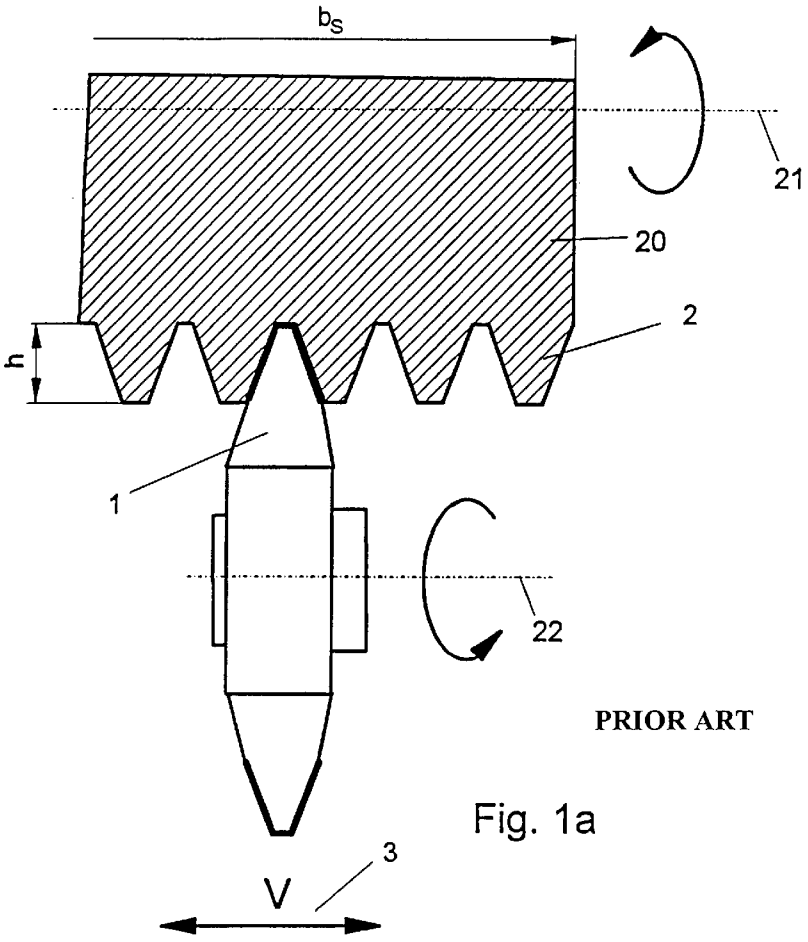
PRIOR ART Fig. 1a

Principle II utilizes a disk-shaped profiling tool that has a radius profile in the active area (FIG. 1*b*). The contact between the profiling tool 1 and the worm thread 2 is punctiform with this tool. During a shifting movement 3 over the grinding worm width $b_s$, only a narrowly limited area of the worm thread height h is profiled. For profiling the entire worm thread, a number of dressing shifts are necessary, wherein the profiling tool is moved a defined amount Δ U along a worm thread axial section after each shifting. Particularly for grinding worms with large modulus, this profiling principle leads to long profiling times. But it is also known that as a result of the punctiform contact in the contact area, this method is quite advantageous for creating modifications over the worm thread height. This method principle is hereinafter referred to as line-by-line dressing.

A grinding device for creating a toothed rack profile is known from DE-32 35 790 A. A wide grinding wheel has numerous regularly spaced, identical circumferential grooves. To dress this grinding wheel, a dressing roll is used with a helical tooth whose profile corresponds to the groove profile of the grinding wheel. During dressing, the dressing roll is shifted synchronously with its angle of rotation in the direction of the grinding wheel axis. The axis of the dressing roll is inclined toward the axis of the grinding wheel according to the gradient of the tooth.

From DE-44 36 741 A, a crushing method for the dressing of profiled, rotationally symmetrical grinding wheels is known in which the dressing roll is coated with grains of hard material exclusively on its tip radius. The contact of the dressing roll and the grinding wheel is punctiform. The circumferential speed of the dressing roll and of the grinding wheel at the point of contact is identical, in such a way that no tangential relative speed occurs at the point of contact.

GOAL OF THE SOLUTION

With the proposed profiling method, the advantages of the two known profiling principles are to be combined and the disadvantages avoided. According to the invention, the method should make it possible to easily create and quickly change modifications over the worm thread height with, at the same time, short profiling times. By using a grinding worm (profiled according to this method) for continuous generating grinding, changed, simple addendum modifications (tip reliefs, root reliefs, root filleting/profile angle) can be reacted to quickly.

Figure 5B:
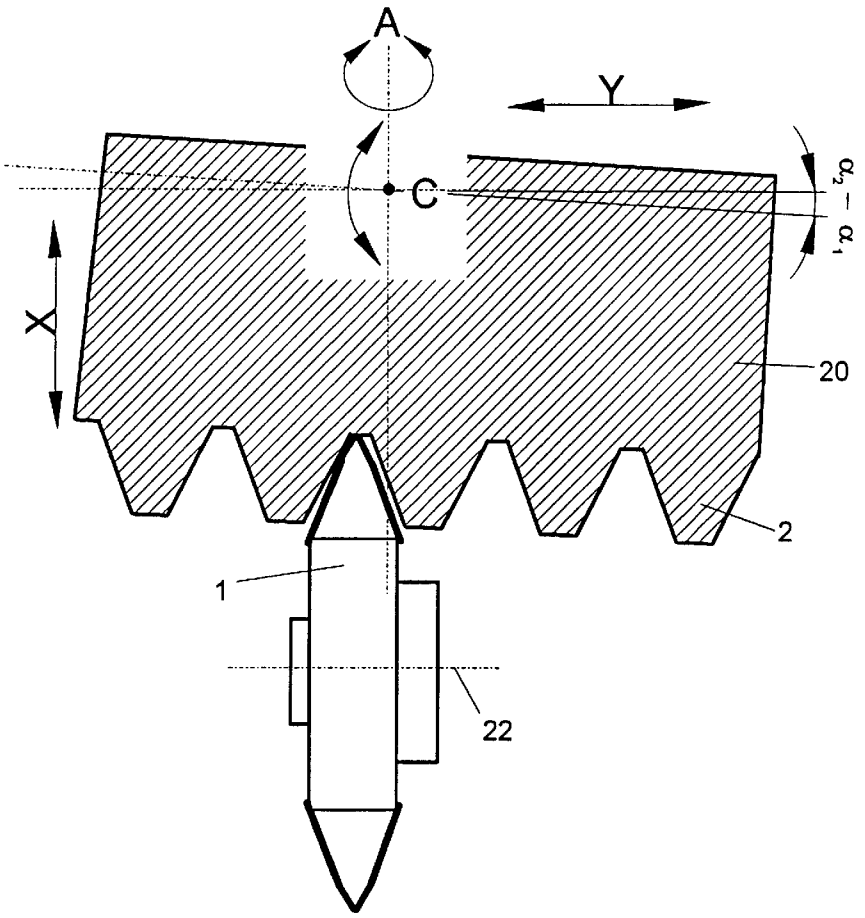
Figure 5A:
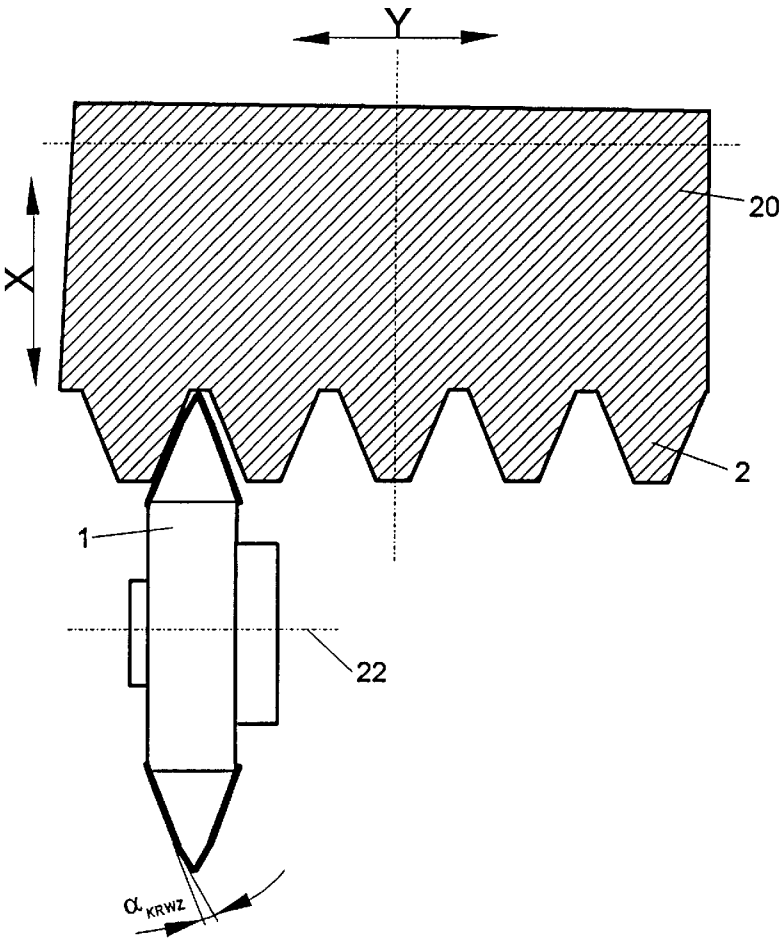

The invention is explained below. The related drawings show:

FIG. 1*a* the principle of profile dressing for the profiling of grinding worms, FIG. 1*b* the principle of line-by-line profiling of grinding worms, FIG. 2*a* the shape elements of an axial section of the grinding worm thread, FIG. 2*b* a swivelling profiling tool composed of several elements in its active area, FIG. 2*c* a coordination matrix for coordination of the elements of the profiling tool with the shape elements of an axial section of the grinding worm thread, FIG. 3*a* through FIG. 3*d* a first example of a sequence for the flexible profiling of grinding worms, FIG. 4*a* through FIG. 4*d* a second example of a sequence for the flexible profiling of grinding worms, and FIG. 5*a* and 5*b* the swivelling of the grinding worm as a further method for flexible profiling of grinding worms.

PROPOSED SOLUTION

The axial section of a grinding worm thread at a defined grinding worm width position can be divided over the thread height h into different shape elements (FIG. 2*a*). For a flank side of the worm thread axial section, for example, the following shape elements result:

tip 4 tip chamfer 5 with the radius r first flank area 6 with the depth crowning radius HER and the contacting angle $\alpha_1$ second flank area 7 with the contacting angle $\alpha_2$ root 8

Each shape element represents its own, delimited, two-dimensional geometrical element (straight line, circle, etc.). A flank side of the grinding worm thread axial section may consist of all shape elements in principle, but does not necessarily have to. A simple case results from the lining up of the shape elements tip, flank and root (in each case for the left and right flank side). The profiling tool shown in FIG. 2*b* is composed in its active area also of individual elements. It may have several linear, radial or other areas for each flank. In the concrete case of FIG. 2*b*, the active area consists of two linear flank areas 9 and 10 and a radial tip area 11. Particularly significant with this profiling tool is the rise of the two linear flank areas differing by the angle $\alpha_{KRWZ}$.

The proposed profiling principle is then based on coordinating, with respect to the profiling and by means of a coordination matrix (FIG. 2*c*), the tip radius as tool element with the shape elements of the grinding worm thread axial section, which must be flexibly changeable (e.g., tip chamfer radius, tip or root reliefs of the flank areas) and/or represent only short linear areas of a worm thread axial section. These shape elements are then dressed (line-by-line) in several profiling shifts. Tool elements that allow a line contact are coordinated with longer areas of the worm thread axial section (for example the flank areas). In this way, the profiling time can be substantially shortened in contrast to line-by-line profiling of the entire worm thread. For some shape elements of the worm thread axial section (e.g., the tip and the root), as a result of their geometric arrangement within the worm thread axial section, usually only one tool element can be chosen. Thus, limiting conditions must be observed in this case.

Universal utilization of the two linear flank areas of the profiling tool makes tipping or swivelling the profiling tool around the figured swivelling axis F (FIG. 2*b*) necessary. By means of this swivelling, the possibility is opened up to profile with a profiling tool the flank areas of the worm thread axial section with different contacting angles (e.g. for creating tip or root reliefs). It is also even possible to vary the difference between the two contacting angles within the interval $0 \leqq \Delta\alpha \leqq (\alpha_1 - \alpha_2)$. It must only be taken into consideration that the difference between the two contacting angles of the flank areas of the worm thread axial section $(\alpha_1 - \alpha_2)$ is always smaller or equal to the angle $\alpha_{KRWZ}$ of the profiling tool. How this swivelling occurs precisely is shown in the following (FIG. 3*a* through FIG. 3*d*) by means of a sequence for the profiling of a flank side of the worm thread (e.g. the left flank).

Figure 3A:
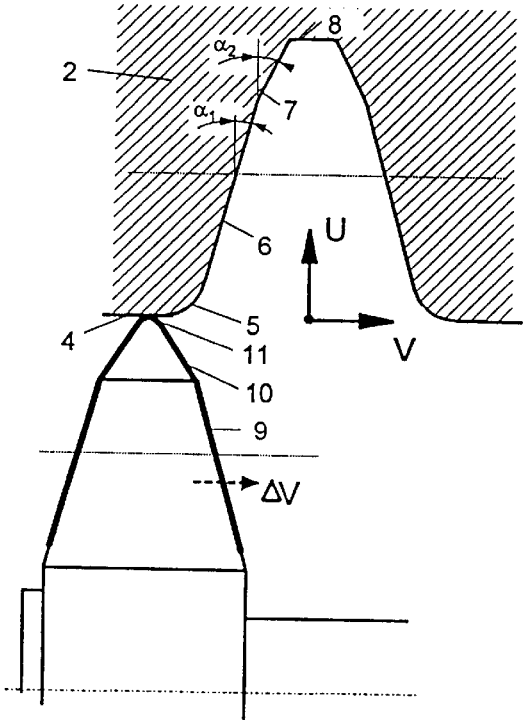
Figure 3B:
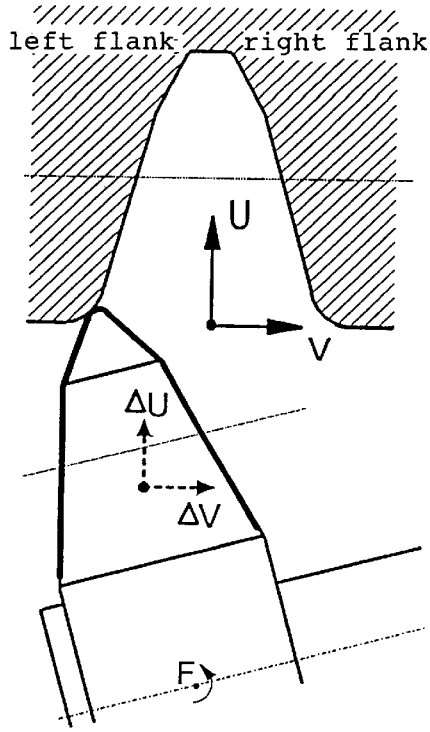
Figure 3C:
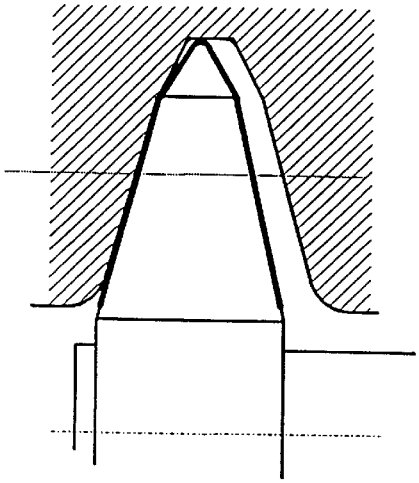
Figure 3D:
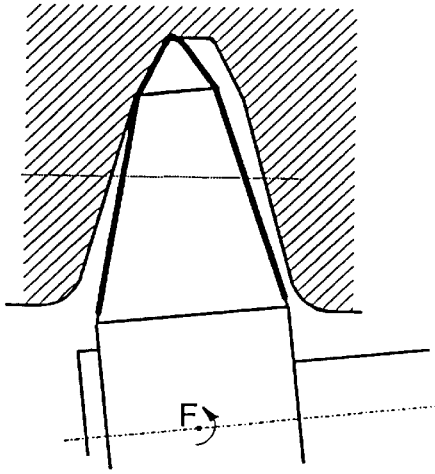
Figure 4A:
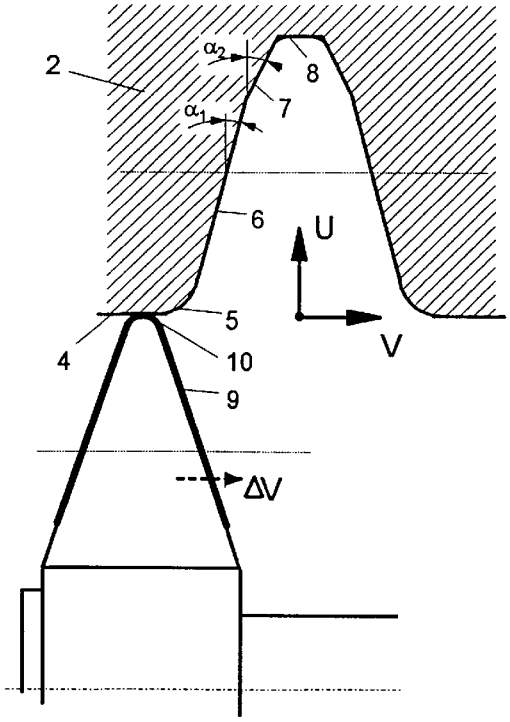
Figure 4B:
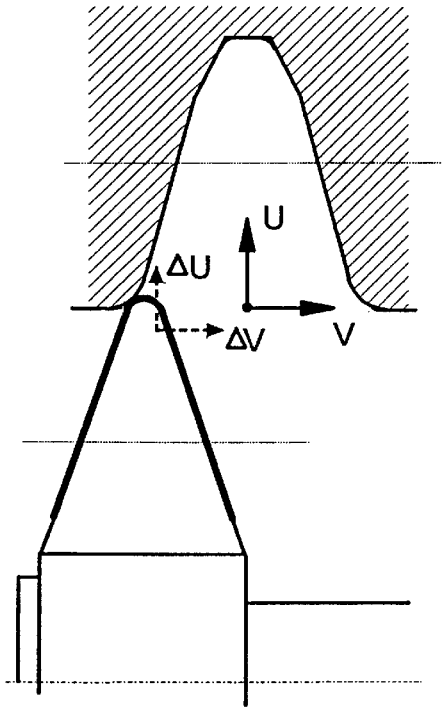
Figure 4C:
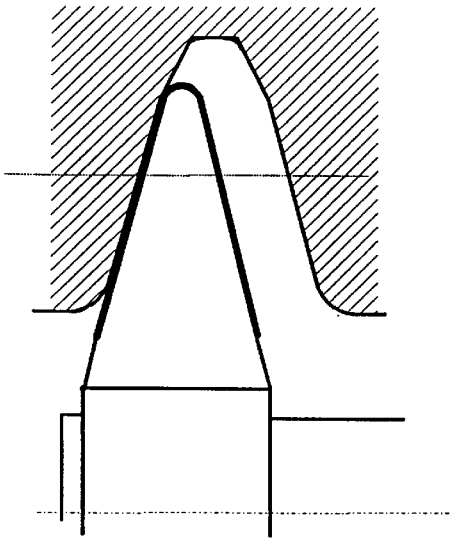
Figure 4D:
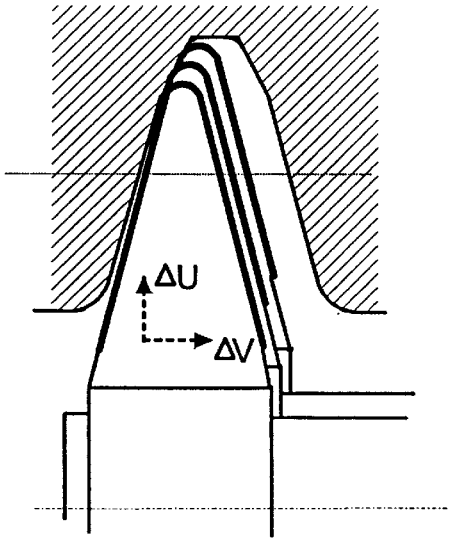

The axial section 2 of the worm thread to be profiled consists, for each flank side, of the five shape elements tip 4, tip chamfer 5, flank area with $\alpha_1$ 6, flank area with $\alpha_2$ 7 and the root 8. A tool element is coordinated with each of these shape elements by means of the coordination matrix, wherein one must consider, based on the criteria profiling time, creation of modifications in worm thread height and the limiting conditions, what tool element is used. The coordination matrix for the example can be seen in FIG. 2*c*. According to this coordination, in principle the profiling procedure can start with each shape element, wherein it is useful to begin at the tip or the root. In the example (FIG. 3*a*) the tip was started with. According to the coordination matrix, this shape element is profiled with the tool element tip radius 11. For this purpose, the tool is fed in once by an infeed increment and then moved along the worm thread tip in several shifts (lines) starting from the middle of the tip of a worm thread axial section. If the end of the shape element is reached, one verifies what shape element is profiled with what tool element next. In the example, this is the tip chamfer 5, which is again (in this case for reasons of flexibility) to be profiled line-by-line with the tip area of the tool 11 (FIG. 3*b*). To obtain a tangential transition to the next shape element, a swivelling of the profiling tool by means of the F-axis by the angle $\alpha_{KRWZ}$ is necessary. If this shape element is also profiled, the first flank area 6 of the worm thread axial section is then profiled. This extends over a larger linear area, in such a way that in this case a line-by-line profiling is ineffective. In this way, via the linear axes U and V, the first linear tool area 9 is engaged with the first flank area 6 of the worm thread axial section (FIG. 3*c*). When profiling the second flank area 7 of the worm thread axial section, a comparable procedure is carried out. Profiling by means of profile dressing in linear contact is also more efficient here. But since the rise (contact angle) of the second flank area 7 of the worm thread axial section differs from the first, the profiling tool must be swivelled by means of the swivelling axis F and moved with the aid of the linear axes U and V in such a way that the second linear area 10 of the tool engages (FIG. 3*d*). Finally, the profiling of the root area 8 of the worm thread axial section takes place once again with the tip area of the profiling tool 11. For this, the tool must be swivelled again into its initial position and accordingly positioned with the linear axes U and V.

The second flank side of the worm thread (the right flank in the example) may be profiled either subsequently to the first or at the same time as the first flank side with a second profiling tool that can be moved with the corresponding axes.

FIGS. 4*a* through 4*d* show a comparable sequence. But in this case, a second linear tool area was not available for the flank area 7 of the worm thread axial section. For this reason, a swivelling of the profiling tool was not necessary for the profiling of the tip chamfer of the worm thread axial section, and the tool element tip radius 11 had to be chosen for the profiling of the shape element 7. The selection of the tool tip radius for the profiling of the flank area 7 can also be favorable particularly when this shape element is linearly short and there is a difference of the contact angle between the flank areas 6 and 7 that is greater than $\alpha_{KRWZ}$ It should also be noted that creating different contact angles of a flank area of the worm thread axial section is possible not only by using the F-axis of the profiling tool but can also be achieved by swivelling the grinding worm around the swivelling axis C and/or the swivelling axis A (FIG. 5*b*). Of course, with these swivelling movements correction movements in direction X and Y are also necessary simultaneously for a proper positioning of the grinding worm thread relative to the profiling tool. In this regard, FIG. 5*a* shows the profiling of the first flank area 6 with the contact angle $\alpha_1$ without swivelling of the grinding worm and FIG. 5*b* shows the swinging in of the grinding worm by means of the C-axis for the profiling of the flank area 7 with the contact angle $\alpha_2$. The condition:

$$\alpha_1 - \alpha_2 \leqq \alpha_{KRWZ}$$

must also be complied with when swivelling with these swivelling axes.

What is claimed is:

1. Method for the profiling of single-start or multistart grinding worms, in which a disk-shaped profiling tool executes a repeated shifting movement along a rotating grinding worm and is positioned suitably to create worm thread height modifications, characterized in that in grinding worm thread axial section areas in which there is no shape modification or only a depth-crown shape modification of the profile, profiling is carried out in the profile dressing method with line contacts, and in flank areas that have shape modifications as well as in the root, tip and tip chamfer areas of a worm thread axial section, profiling is carried out in the line-by-line dressing method with punctiform contact, whereby each of the two flank sides of a grinding worm thread axial section is divided into individual shape elements for this purpose.

2. Method for the profiling of single-start or multistart grinding worms, in which a disk-shaped profiling tool executes a repeated shifting movement along a rotating grinding worm, characterized in that to create two shape elements with different contact angles of a worm thread axial section, between two profiling shifts a special profiling tool executes an additional movement in the form of a swivelling movement around a swivelling axis relative to the grinding worm, wherein the size of the swivelling angle depends on the difference of the desired contact angle $(\alpha_1-\alpha_2)=\Delta\alpha_{KR}$ and on the geometry of the profiling tool.

3. Method according to claim 1 or 2, characterized in that individual profiling tool elements of a special disk-shaped profiling tool are coordinated with shape elements of a grinding worm thread axial section on the basis of a coordination matrix.

4. Disk shaped profiling tool for profiling of single start or multistart grinding worms, the tool comprising two flanks coated with grains of hard material and each having in an axial section a straight or curved segment (9) for dressing in the profile dressing method, characterized in that the tool additionally has a tip chamfer radiaus (11) for line-by-line dressing, said flanks converging towards said tip, characterized in that it has two straight or curved segments (9, 10) at both flanks in the axial section, wherein contact angles of the two segments (9, 10) interest in an angle $(\alpha_{KRWZ})$.

5. Device for profiling single start or multistart grinding worms, comprising a grinding spindle with a grinding spindle axis (21) as well as a profiling spindle with a profiling spindle axis (22), wherein the profiling spindle is displaceable relative to the grinding spindle parallel to the grinding spindle axis (21) and can be fed radially, characterized in that the profiling spindle can be swivelled relative to the grinding spindle around an axis perpendicular to a common plane of the grinding spindle axis (21) and the profiling spindle axis (22).

* * * * *